United States Patent [19]

Troiano

[11] 4,280,698

[45] Jul. 28, 1981

[54] GOLF CUP COVER AND PUTTING AID

[76] Inventor: Joseph Troiano, 80 Mahan St., West Babylon, N.Y. 11704

[21] Appl. No.: 168,310

[22] Filed: Jul. 10, 1980

[51] Int. Cl.[3] ..... A63B 57/00

[52] U.S. Cl. ..... 273/34 B; 273/178 R

[58] Field of Search ..... 273/34 B, 178 R, 176 J, 273/176 H, 195 A, 34 R, 177 R

[56] References Cited

U.S. PATENT DOCUMENTS

| | | | |
|---|---|---|---|
| 3,870,301 | 3/1975 | Brisendine | 273/34 B |
| 3,885,795 | 5/1975 | Brewer | 273/34 B |

FOREIGN PATENT DOCUMENTS

| | | | |
|---|---|---|---|
| 220377 | 8/1924 | United Kingdom | 273/34 B |

*Primary Examiner*—George J. Marlo

*Attorney, Agent, or Firm*—Richard L. Miller

[57] ABSTRACT

A cover placable upon a top of a cup used as a hole on a golf course; the cover including a small central opening that is just large enough for a golf ball to enter, and an upper side of the cover surrounding the opening having simulated grass affixed thereupon which matches actual grass growing around the golf course hole. The cover is supported on the cup by spurs which extend sidewardly of the cover's perimeter and alternately positioned flexible fingers which extend downwardly from the periphery of the cover and fit tightly against the inside wall of the cup.

1 Claim, 5 Drawing Figures

Fig. 1
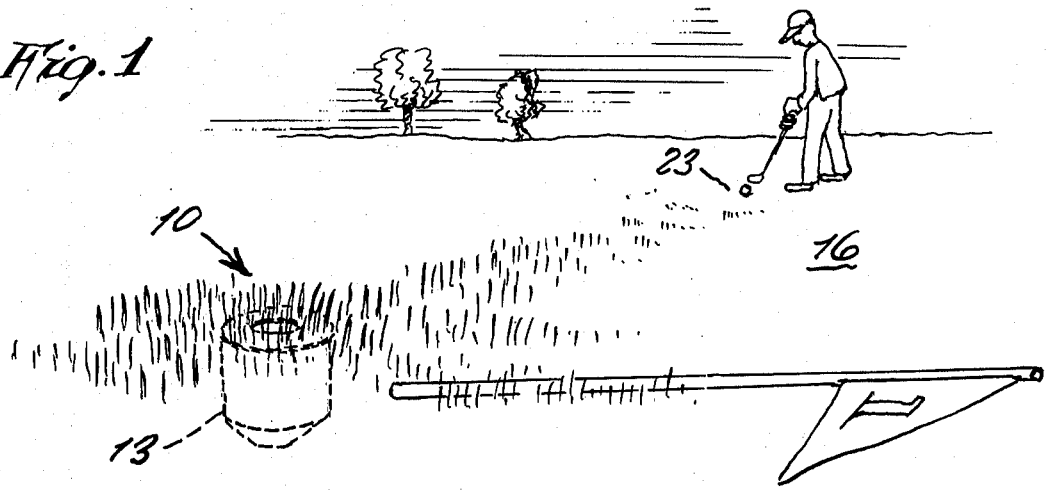
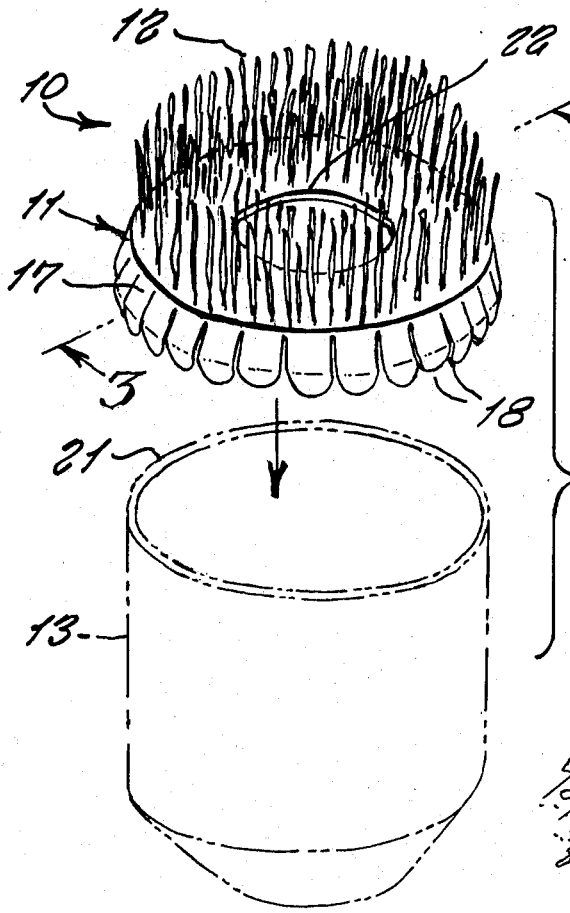
Fig. 2
Fig. 3
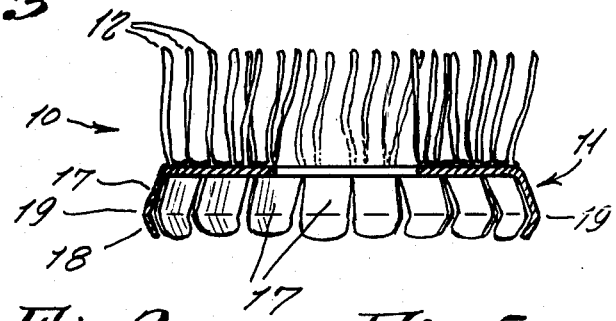
Fig. 5
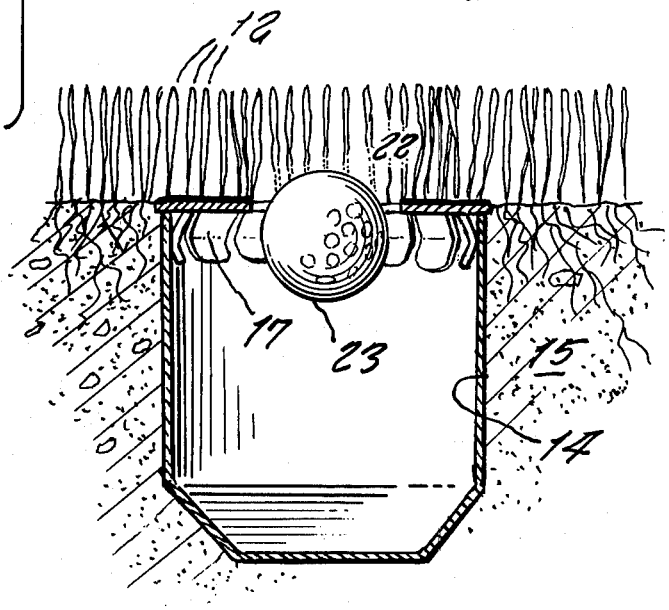
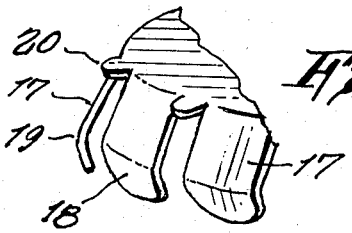
Fig. 4

GOLF CUP COVER AND PUTTING AID

BACKGROUND OF THE INVENTION

It is well known that all golf players, like players in all other sports, must practice in order to improve their skill. Accordingly they do considerable practice in putting a golf ball upon a green toward a hole. Such holes are made by a cup being inserted into the ground to a level with the ground surface; such cups having a mouth diameter that is considerably larger than the diameter of the golf ball, so that the ball will successfully enter the hole even if it is not traveling toward a center of the hole. While putting practice toward such hole will improve the player's skill, there is a need for a greater challange for those players who already are quite skilled in such putting.

SUMMARY OF THE INVENTION

Therefore it is a principal object of the present invention to provide a golf practice aid which reduces the size of the hole entry opening, so that a greater skill is needed on aiming the ball so that it succeeds in getting into the hole.

Another object is to provide a golf practice aid which simply comprises a cover that fits on a top of the cup in the hole, the cover having a smaller opening than the cup; the cover being quickly and easily applied or removed, as wished.

Still a further object is to provide a golf practice aid which includes grass extending to the edge of the opening, such as with a conventional cup, so that the golf ball travels in grass up to the edge of the hole opening.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows:

FIG. 1 is a perspective view of the invention shown in use on a golf course hole cup.

FIG. 2 is a perspective view of the invention shown positioned for installation in a top of the hole cup.

FIG. 3 is a side cross sectional view taken on line 3—3 of FIG. 2.

FIG. 4 is an enlarged detail of the invention; showing short teeth between the prongs so as to prevent the invention from sliding down deep into the hole.

FIG. 5 is a cross sectional view of the invention shown installed on the cup, and illustrated in use with a golf ball rolling thereinto.

DETAILED DESCRIPTION OF PREFERRED EMBODIMENT

Referring now to the drawing in greater detail, the reference numeral 10 represents a golf practice aid, according to the present invention, wherein the same is comprised of a one-piece metal stamping so to form a cover 11, and a quantity of simulated grass 12 being applied to its upper side.

The cover is made circular in shape and in a size so as to fit a top of a conventional cup 13 such as is used for lining a hole 14 dug in the ground 15 of a golf course putting green 16.

The periphery of the cover is die-cut with a plurality of teeth 17 that are angularly outwardly bent downward for being fitted inside the cup. A terminal tip 18 of each tooth is bent inwardly angularly so as to serve as a pilot in guiding the tooth into the mouth of the cup. A corner 19 of each tooth bears against the inner side of the cup side wall preventing a loose fit and shifting of the cover.

In order that the cover is stopped from dropping down into a lower part of the cup, and is held within the mouth entry of the cup, there may be stamped out a short spur 20 between each tooth, the spur extending straight sidewardly in order to rest upon a top edge 21 of the cup, as shown in FIGS. 4 and 5.

Except for the teeth, the cover is made flat. A central opening 22 is made of a size so that a golf ball 23 just fits therethrough so as to drop into the cup. Thus the size of the opening for the hole is reduced approximately by one-half.

A quantity of the simulated grass 12 is adhered to the upper side of the cover, the grass being made to look like real grass growing on the green by being of similar color, a same length and a same density of grass blades adjacent each other. The simulated grass stands upright upon the cover and is secured thereto by suitable adhesives. Also the texture of the simulated grass is made the same as real grass so that it offers the same resistance to the ball traveling thereupon.

In operative use, it is now evident that a golf ball putted to the opening 22 travels across grass to the edge of the opening before dropping therein.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A golf practice aid comprising a cover having a central aperture for passage therethrough of a golf ball, said central aperture being circular in shape and having a diameter slightly larger than a golf ball; a plurality of fingers extending downwardly from the perimeter of the bottom surface of said cover, each of said plurality of fingers comprising a first portion projecting outwardly away from said perimeter and a second portion connected to said first portion and projecting inwardly toward the perimeter, said first and second portions meeting to form a sharp edge for bearing against the inner surface of a golf cup to hold said cover therein; a plurality of spurs extending from the perimeter of said cover, each of said plurality of spurs being positioned between two of said plurality of fingers, each said spur being coextensive and coplanar with said cover such that an acute angle is formed between each said spur and a respective one of said plurality of fingers; said cover being of circular cross-section and said plurality of spurs and said plurality of fingers being mounted about said cover in circular alternating fashion; said plurality of fingers being flexible for tight fitting in a golf cup; and a quantity of simulated grass mounted on the top surface of said cover remote from said bottom surface, said quantity of simulated grass forming an opening at the center thereof for access to said central aperture of said cover, whereby said cover may be readily inserted in a golf cup in order to reduce the size of the hole to which a golf ball is stroked.

* * * * *